US008637754B2

(12) United States Patent
St. George

(10) Patent No.: US 8,637,754 B2
(45) Date of Patent: Jan. 28, 2014

(54) SYSTEMS AND METHODS FOR ROTATING THE BELL OF A MUSICAL INSTRUMENT

(76) Inventor: Donald St. George, Elm Grove, WI (US)

( * ) Notice: Subject to any disclaimer, the term of this patent is extended or adjusted under 35 U.S.C. 154(b) by 0 days.

(21) Appl. No.: 13/489,107

(22) Filed: Jun. 5, 2012

(65) Prior Publication Data

US 2012/0240745 A1 Sep. 27, 2012

Related U.S. Application Data

(63) Continuation of application No. 12/930,541, filed on Jan. 10, 2011, now Pat. No. 8,193,432, and a continuation of application No. 12/800,682, filed on May 20, 2010, now abandoned, and a continuation of application No. 12/590,201, filed on Nov. 4, 2009, now abandoned, and a continuation of application No. 12/384,969, filed on Apr. 10, 2009, now abandoned.

(60) Provisional application No. 61/123,686, filed on Apr. 10, 2008.

(51) Int. Cl.
*G10D 7/00* (2006.01)

(52) U.S. Cl.
USPC ..... 84/388

(58) Field of Classification Search
USPC ..... 84/388
See application file for complete search history.

(56) References Cited

U.S. PATENT DOCUMENTS

| | | | | |
|---|---|---|---|---|
| 1,605,101 | A | 11/1926 | Dreves | |
| 1,880,961 | A | 10/1932 | Kingsley | |
| 2,545,227 | A | 3/1951 | Comer | |
| 2,792,666 | A | 5/1957 | Green | |
| 2,957,381 | A | 10/1960 | Hillyard | |
| 4,069,734 | A | 1/1978 | Colaianni | |
| 4,178,830 | A | 12/1979 | Ramirez | |
| 4,723,470 | A | 2/1988 | Yamaryo | |
| 5,000,072 | A | 3/1991 | Pascucci | |
| 5,375,498 | A | 12/1994 | Obuchi | |
| 7,504,571 | B2 | 3/2009 | Hilliard et al. | |
| 8,193,432 | B2 * | 6/2012 | St. George | 84/388 |
| 2011/0303073 | A1 * | 12/2011 | St. George | 84/390 |
| 2012/0227567 | A1 * | 9/2012 | Barberot et al. | 84/387 R |
| 2012/0240745 | A1 * | 9/2012 | St. George | 84/390 |

* cited by examiner

*Primary Examiner* — Robert W Horn
(74) *Attorney, Agent, or Firm* — Ryan Krumholz & Manion, S.C.

(57) ABSTRACT

A rotation device is adapted to be installed between the bell of a musical wind instrument and the body of the musical instrument. One or more rotational devices may be controlled by the musician or someone else while the musician is performing and/or playing the instrument. The rotation device may control the speed of rotation, the direction of rotation, and the amount of travel of rotation. The amount of travel of rotation of the bell may be more than and/or equal to and/or less than a 360 degree rotation.

18 Claims, 4 Drawing Sheets

SYSTEMS AND METHODS FOR ROTATING THE BELL OF A MUSICAL INSTRUMENT

RELATED APPLICATION

This application is a continuation of application Ser. No. 12/930,541 filed 10 Jan. 2011, which is a continuation of application Ser. No. 12/800,682 filed 20 May 2010, which is a continuation of patent application Ser. No. 12/590,201 filed 4 Nov. 2009, which is a continuation of application Ser. No. 12/384,969, filed 10 Apr. 2009, which claims the benefit of co-pending U.S. provisional application Ser. No. 61/123,686 filed 10 Apr. 2008.

FIELD OF THE INVENTION

The invention relates generally to functional adaptation to musical instruments, and more particularly to creating and/or modifying a musical wind instrument to allow the musician to control rotational movement of the musical instrument's bell.

BACKGROUND OF THE INVENTION

Musicians generally perform individually or in groups, i.e., a band. And, a band can include a single musician (a "one man band") all the way up to a hundred or more musicians. One style of a band that typically includes more than just a few musicians is called a marching band. A marching band is a group of instrumental musicians that incorporate a wide range of movements into their musical performance. A wide variety of instruments may be used in the band, including brass, woodwinds, and percussion instruments, to produce a strong and stable rhythmic component suitable for marching and movement. Based primarily on the "marching" aspect of the band, most marching bands incorporate some form of a uniform, generally including the colors and/or symbols of the school or organization, and can be as detailed as a military style uniform, to as informal as matching t-shirts and shorts.

In addition to the traditional street parade performances, many marching bands also perform field shows at sporting events or at competitions. The goal of each band's performance is different. Some aim for maximum uniformity and precision, while others—especially scramble bands—aim to be as entertaining as possible. Many high school and college marching bands aim for maximum sound and visual impact on the audience.

High school and college sporting events, especially half time of football games, has become a premiere opportunity for schools to display the skills and uniqueness of their marching bands to the players, the fans, and those watching the sporting event on television. High schools and colleges are constantly trying to improve the "wow" effect of their marching bands to impress all those who watch and enjoy the performance.

The musical instruments themselves provide little toward the "wow" factor, other than the music they produce and any movements that the musician makes that incorporate the musical instrument.

Accordingly, there is a need for improved systems and methods that allow musical instruments to be used by the musicians that can improve the "wow" effect of a band, such as being able to move or rotate the bell of a musical instrument by the simple push of a button, while the musician is playing the instrument.

SUMMARY OF THE INVENTION

Systems and methods provide a movement and/or rotation device adapted to be installed or otherwise incorporated between the bell of a musical wind instrument and the body of the musical instrument. The rotation device may be controlled by the musician while the musician is performing and playing the instrument, or may be controlled remotely by someone other than the musician. The rotation device controls the movement of the bell, including rotating the bell more than and/or equal to and/or less than a 360 degree rotation.

In one embodiment, the systems and methods provide functional adaptation to musical instruments, and more particularly provide modification to a musical instrument to allow the musician to control rotational movement of the musical instrument's bell.

In another embodiment, the systems and methods provide means for rotating the bell of a musical wind instrument, the musical wind instrument adapted to be played by a musician, means for controlling the means for rotating the bell of the musical wind instrument, and means for providing power to the means for rotating the bell of the musical wind instrument.

In yet another embodiment, the systems and methods provide for rotating the bell of a musical wind instrument, the systems and methods comprising a driver adapted to rotate the bell of the musical instrument, a source of power adapted to provide power to the driver, and a controller operationally coupled to the source of power, and adapted to control the driver so as to allow for the control of the driver to rotate the bell of the musical wind instrument.

In yet another embodiment, the systems and methods provide for rotating a bell of a musical wind instrument, the systems and methods comprising providing means for rotating the bell of the musical instrument, providing means for controlling the means for rotating the bell, and operating the controls for rotating the bell of the musical instrument.

DESCRIPTION OF THE PREFERRED EMBODIMENT

Figure 1:
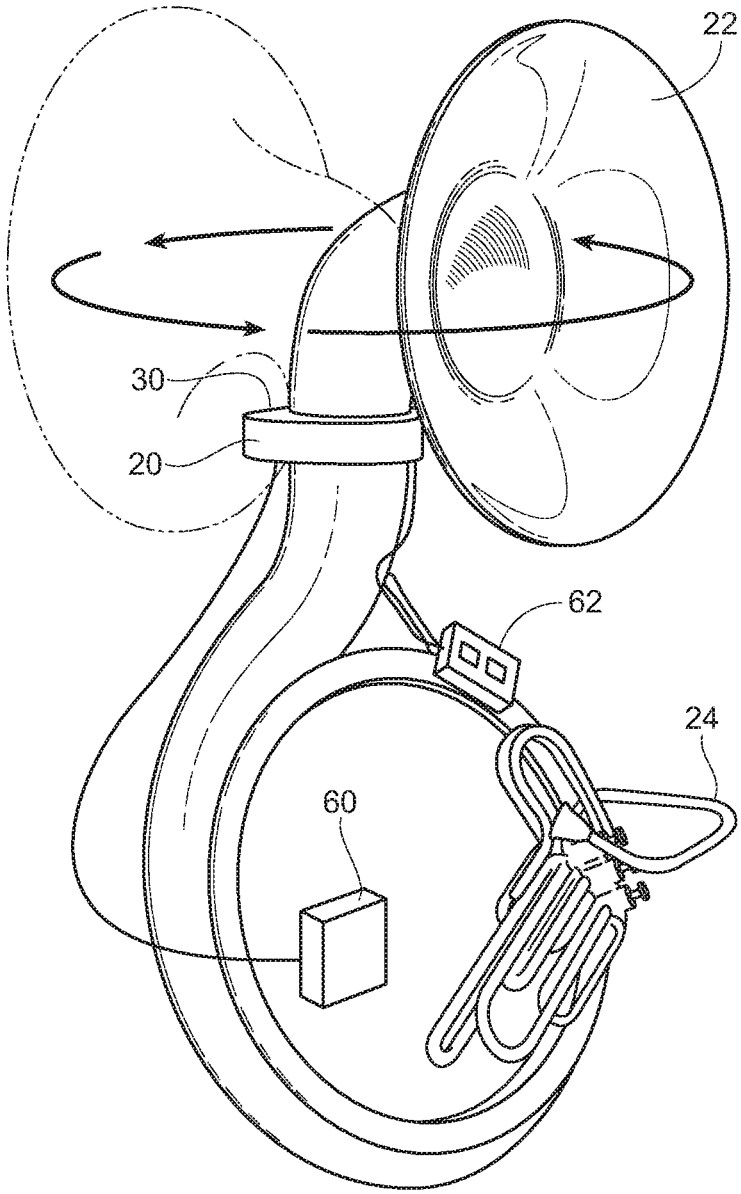
FIG. 1 is a perspective view of a musical instrument incorporating a system for rotating the bell of the instrument.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Referring now to the drawings, wherein like numerals represent like parts throughout the views, there is generally designated at 20 a movement/rotation device adapted to move, e.g., rotate the bell 22 of a musical wind instrument 24. The rotation device 20 allows the musician (or someone else) to rotate the bell 22 in a 360 degree circle, or more or less.

One notable instrument that is used in many bands, including the marching band, to impress the audience is the tuba, or also referred to as the sousaphone (the wearable tuba), because of its impressive size and sound. The various aspects of the rotational device 20 will be described in connection with rotating the bell of a sousaphone. That is because the features and advantages that arise due to the invention are well suited to this purpose. Still, it should be appreciated that the various aspects of the invention can be applied to other musical instruments as well.

Figure 2:
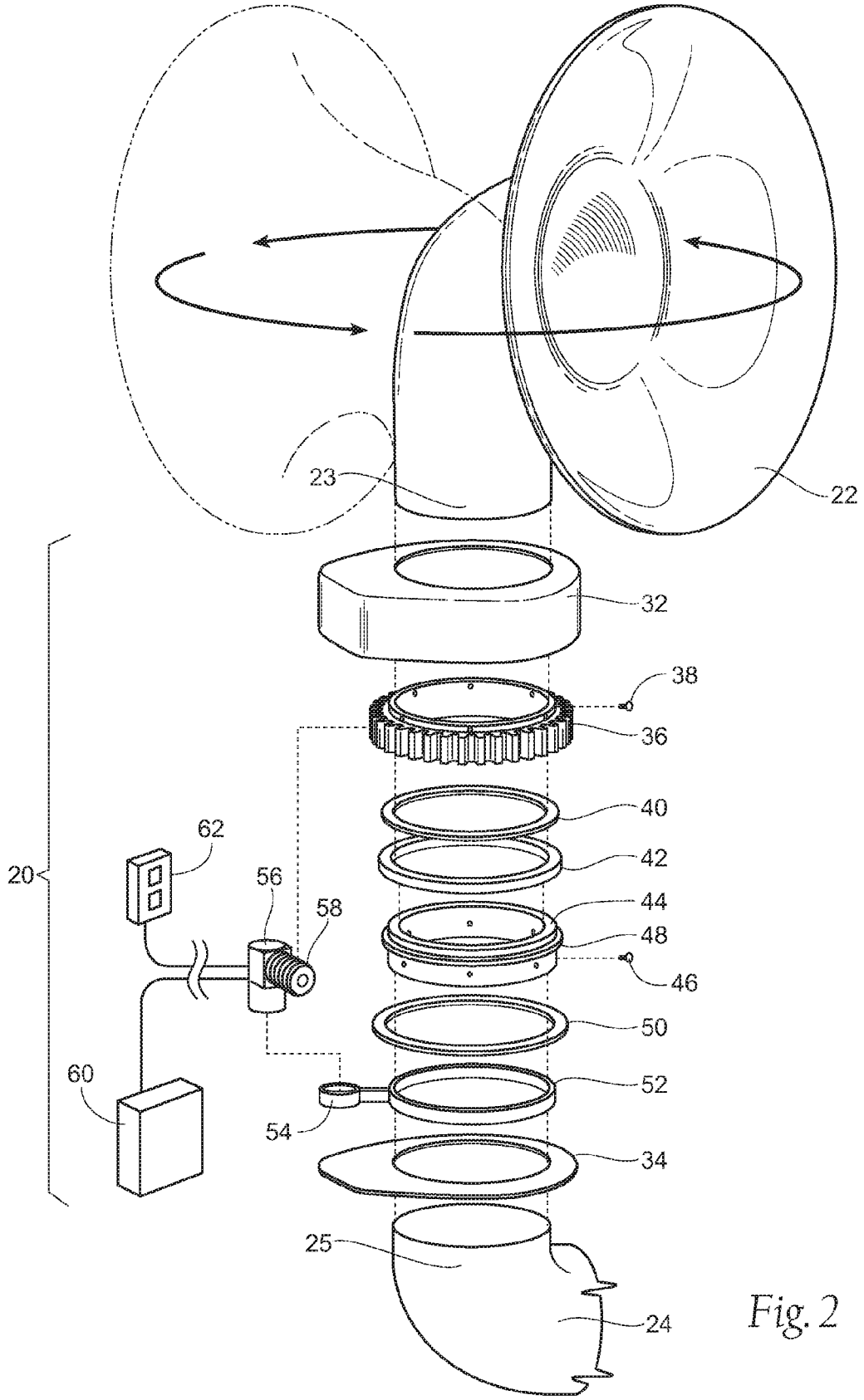
FIG. 2 is an exploded perspective view of a portion of the musical instrument shown in FIG. 1, showing components of the system for rotating the bell of the instrument.
Figure 3:
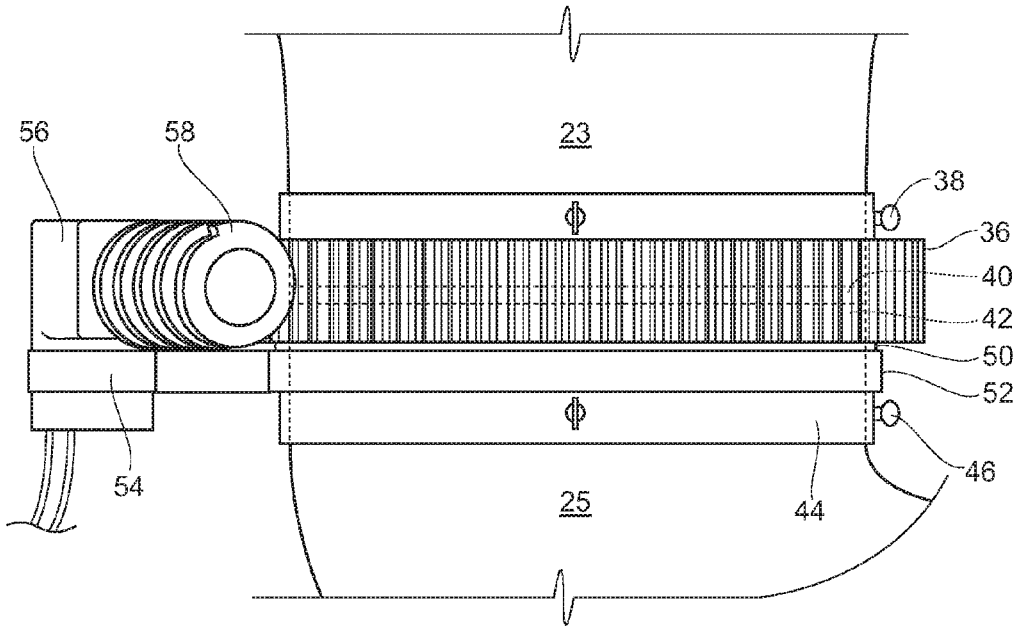
FIG. 3 is a close-up perspective view of the system for rotating the bell of the instrument shown in FIG. 2.

As seen particularly in FIGS. 1 through 3, the rotation device 20 may be enclosed within or include a housing 30. The housing, if used, may include a top portion 32 and a bottom portion 34, or alternatively, side portions, for example. The housing may be made of a variety of materials, including plastics, and/or metals, such as aluminum or brass, to match the musical instrument.

Means for rotating the bell 22 of the musical instrument 24 may be positioned within or on or outside the housing 30. As can be seen particularly in the exploded view of FIG. 2, and as a non-limiting example, means for rotating the bell are described below. For example, the mounting end 23 of the bell 22 may slide within the inner diameter or hub of a gear 36. One or more thumb screws 38 or the like, including glues, welding, press fit, as non-limiting examples, may be used to secure the gear 36 to the mounting end 23 of the bell 22.

A gasket 40 may be seated between the gear 36 and the top side of a rotary bearing 42. The bearing 42 permits relative motion between the gear 36 and a bearing seat 44. One or more thumb screws 46 or the like, as previously described, may be used to secure the bearing seat 44 to the mounting end 25 of the musical instrument 24. As can be seen, the bearing seat 44 may include a lip 48 which supports the bearing 42.

An additional gasket 50 may be positioned on or around the lower side of the bearing 42. Below the gasket 50, and below the lip 48 of the bearing seat 44, a driver support bracket 52 may be positioned around the bearing seat 44. The support bracket 52 may include a support arm 54 for mounting the driver 56. It is to be appreciated that the driver 56 may be mounted in other configurations as well, such as the driver may be mounted to the housing 30, or the driver may be mounted to the instrument 24, as non-limiting examples.

Figure 4:
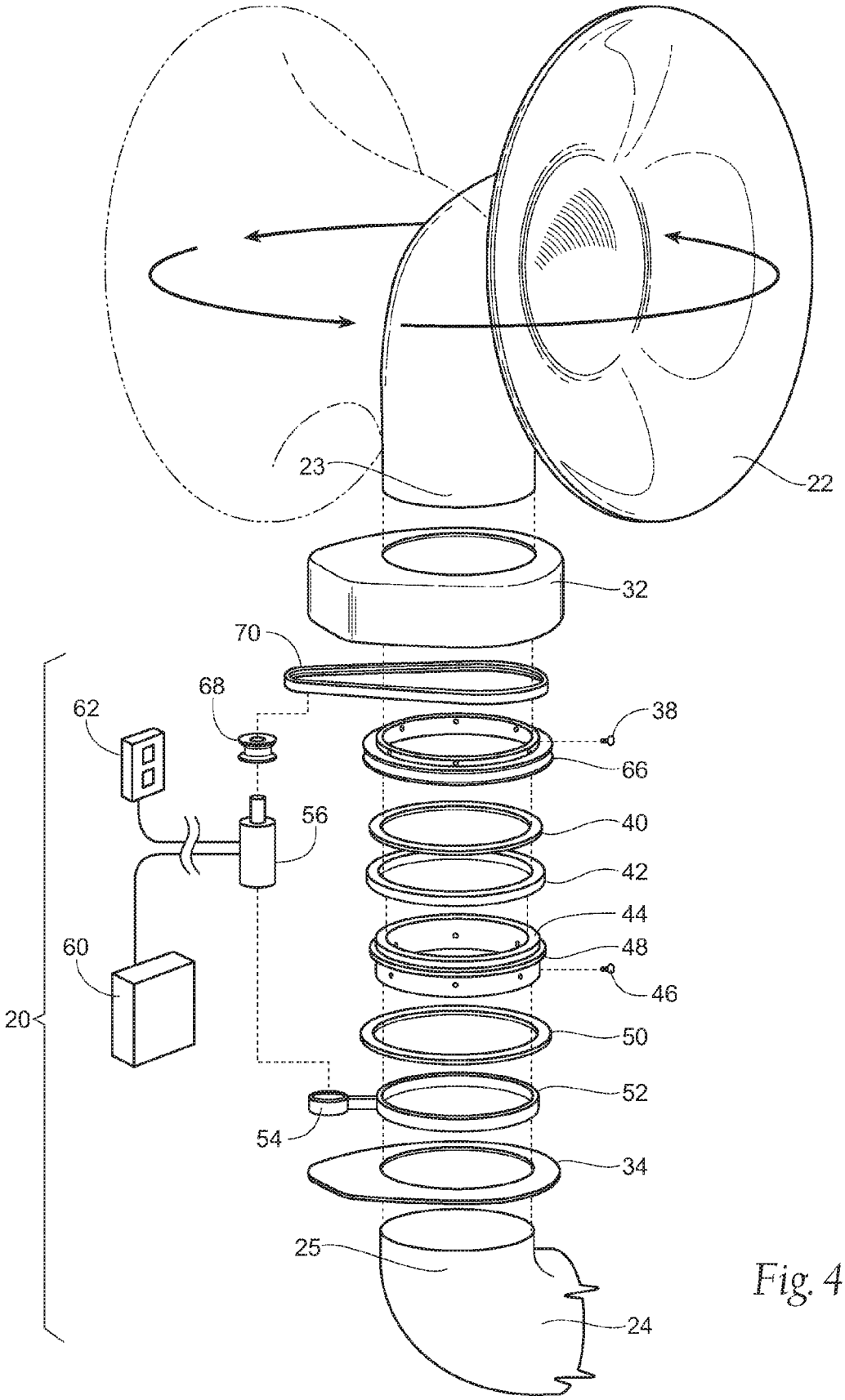
FIG. 4 is an exploded perspective view of a portion of the musical instrument shown in FIG. 1, showing alternative components of the system for rotating the bell of the instrument.

In one embodiment, the driver 56 comprises an electric motor and gear, such as a worm gear, although other driver mechanisms are possible, such as stepper motors, servo motors, electromagnetic, hydraulic, pneumatic, direct drive, drive shaft, belt and pulley configurations (see FIG. 4), and the like. The driver 56 may be a fixed speed driver, or it may be a variable speed driver. As can be seen, as the gear 58 of the driver 56 rotates, the gear 36 in turn rotates causing the bell 22 to rotate. It is to be appreciated that in alternative configurations, gear 36 and/or gear 58 may be replaced with other mechanisms, such as pulley 66 and pulley 68, as can be seen in FIG. 4.

In one embodiment, means for powering the rotational device 60 provides power to the driver 56. The means for powering may be by mean way of a power supply 60. The power supply may comprise any one or more of known sources of power, including, but not limited to a battery, a capacitor, solar, wind, magnetic, and any source of power generated by movement. The power supply 60 may be positioned within or on or outside the housing 30, or the power supply 60 may be configured as a portable power supply that is electrically coupled to the driver 56 and then may be carried by the musician or coupled to the instrument, for example. Desirably, the power supply 60 is a rechargeable power supply, although not required.

The rotation device 20 also desirably includes means for controlling the rotational device 20. A control unit 62 may be operationally coupled (e.g., wirelessly, electrically, optically, infrared), to the driver 56 to provide control of the rotation device 20. By way of non-limiting examples, the control unit 62 can include on/off controls, and/or directional controls, and/or speed controls to allow the musician or someone other than the musician to operate the functionality of the rotational device 20 during the course of use of the instrument, such as during a practice or performance. The control unit may also be operated by someone other than the musician to allow the musician to focus on playing the instrument.

More than one rotational device 20 may be controlled by a control unit 62. For example, a band may consist of four musical instruments, each having a rotational device 20. The control unit 62 may be operated by a musician or by someone else to control the operation of the four rotational devices. This feature would allow for accurate rotation in unison of the four (or more or less) rotational devices 20 and associated bells of each of the musical instruments.

It is to be appreciated that features of the rotation device 20 as described above may vary in their assembly and/or configuration. For example, the gear 36 or pulley 66 may be positioned over or on the mounting end 25 of the musical instrument 24 instead of over or on the mounting end 23 of the bell 22. The gaskets 40, 50 may or may not be used, and/or additional gasketing may be used, and their positions relative to the gear 36 or pulley 66 and bearing 42 and bearing seat 44 may be adjusted. The support bracket 52 including the support arm 54 may also be an integral element of the bearing seat 44 instead of being a distinct component. The bearing 42 and/or bearing seat 44 may or may not be used. Other modifications for allowing rotation of the bell 22 of the musical instrument 24 are also within the scope of the invention.

The foregoing is considered as illustrative only of the principles of the invention. Furthermore, since numerous modifications and changes will readily occur to those skilled in the art, it is not desired to limit the invention to the exact construction and operation shown and described. It is to be appreciated that the embodiments shown may consist of fewer devices as shown, i.e., the use of consisting of or consisting essentially of is within the scope of the invention and the claims. While the preferred embodiment has been described, the details may be changed without departing from the invention, which is defined by the claims.

I claim:

1. An apparatus for causing rotational movement of a bell of a musical wind instrument, the apparatus comprising:
- a motor coupled to the musical wind instrument;
- a gear sprocket coupled to the musical wind instrument;
- a pulley coupled to the motor; and
- a belt coupled to the gear sprocket and the pulley.

2. The apparatus according to claim 1,
- wherein the pulley is a toothed pulley, and the sprocket is a toothed sprocket, and the belt is a toothed belt.

3. The apparatus according to claim 1,
- further including a power supply electrically coupled to the motor.

4. The apparatus according to claim 1,
- wherein the musical wind instrument includes an instrument base and the bell, and the motor is coupled to the instrument base and the gear sprocket is coupled to the bell.

5. The apparatus according to claim 1,
- wherein the gear sprocket includes a ball bearing assembly.

6. The apparatus according to claim 5,
- wherein the ball bearing assembly is positioned between the instrument base and the bell.

7. The apparatus according to claim 1,
- further including a gear box coupled to the motor.

8. A method for causing rotational movement of a bell of a musical wind instrument, the method comprising:

attaching a rotational mechanism to at least one of a main body of the musical wind instrument and the bell of the musical wind instrument; and operating a control unit for causing the rotational mechanism to at least partially rotate the bell.

9. The method according to claim 8, further including providing power to the rotational mechanism.

10. The method according to claim 8, wherein the rotational mechanism comprises a motor coupled to the musical wind instrument;

a gear sprocket coupled to the musical wind instrument;

a pulley coupled to the motor; and a belt coupled to the gear sprocket and the pulley.

11. The method according to claim 8, wherein attaching the rotational mechanism to the at least one of the main body of the musical wind instrument and the bell of the musical wind instrument further includes attaching a driver support bracket to the musical wind instrument, and attaching a driver to the driver support bracket.

12. The method according to claim 8, further including operating the control unit for controlling the speed of rotating the bell.

13. A method comprising:

operating a rotational mechanism that is coupled to a musical wind instrument; and the rotational mechanism rotating a bell of the musical wind instrument.

14. The method according to claim 13, further including providing power to the rotational mechanism.

15. The method according to claim 13, further including rotating the bell of the musical wind instrument for at least 45 degrees of rotation.

16. The method according to claim 13, further including positioning at least a portion of the rotational mechanism between a main body of the musical wind instrument and the bell of the musical wind instrument.

17. The method according to claim 13, wherein positioning the at least a portion of the rotational mechanism between the main body of the musical wind instrument and the bell of the musical wind instrument further includes attaching a driver support bracket to the musical wind instrument, and attaching a driver to the driver support bracket.

18. The method according to claim 13, further including controlling the speed of rotating the bell of the musical wind instrument.

* * * * *

UNITED STATES PATENT AND TRADEMARK OFFICE

CERTIFICATE OF CORRECTION

PATENT NO. : 8,637,754 B2
APPLICATION NO. : 13/489107
DATED : January 28, 2014
INVENTOR(S) : Donald St. George It is certified that error appears in the above-identified patent and that said Letters Patent is hereby corrected as shown below:

On the Title Page
item (74) Attorney, Agent, or Firm Delete "Ryan Krumholz & Manion, S.C." and substitute -- Ryan Kromholz & Manion, S.C. --

Signed and Sealed this
First Day of July, 2014

Michelle K. Lee

Michelle K. Lee
*Deputy Director of the United States Patent and Trademark Office*